United States Patent [19]

Meyerson

[11] 4,231,502

[45] Nov. 4, 1980

[54] WATCH BRACELET

[76] Inventor: Stanley Meyerson, 1111 Ocean Ave., Brooklyn, N.Y.

[21] Appl. No.: 933,898

[22] Filed: Aug. 15, 1978

[51] Int. Cl.[3] ..... A44C 5/14

[52] U.S. Cl. ..... 224/177; 24/265 WS

[58] Field of Search ..... 224/4 D, 4 E, 28 W, 224/177, 164, 168; 24/265 WS, 265 R; 63/3, 4, 5 R

[56] References Cited

U.S. PATENT DOCUMENTS

| | | | |
|---|---|---|---|
| 1,742,464 | 1/1930 | Eklund | 24/265 WS X |
| 3,332,592 | 7/1967 | Bürkle | 224/4 D |
| 3,562,878 | 2/1971 | Shteinshleifer | 24/265 WS |
| 3,565,304 | 2/1971 | Kalinsky | 224/4 E |
| 3,612,365 | 10/1971 | Dintsman | 24/265 WS X |
| 3,795,353 | 3/1974 | Weiss | 24/265 WS X |
| 3,964,652 | 6/1976 | Fuld | 24/265 WS X |

FOREIGN PATENT DOCUMENTS

| | | | |
|---|---|---|---|
| 1104242 | 4/1961 | Fed. Rep. of Germany | 24/265 WS |

*Primary Examiner*—Robert J. Spar
*Assistant Examiner*—Jerold M. Forsberg
*Attorney, Agent, or Firm*—Lackenbach, Lilling & Siegel

[57] ABSTRACT

A bracelet for connection to a watch casing, having a lug with a retaining boss, includes a band with a hollow housing across one end. The hollow housing has a wide opening for receiving the lug. A captive resilient element in the housing is deflectable therein to pass the lug and is releasable to a lug retaining position for engagement with the boss.

6 Claims, 5 Drawing Figures

FIG. 1
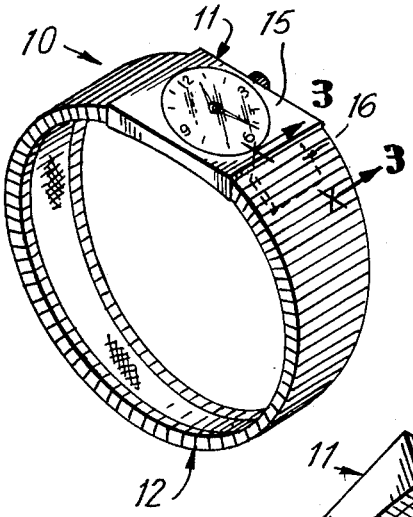
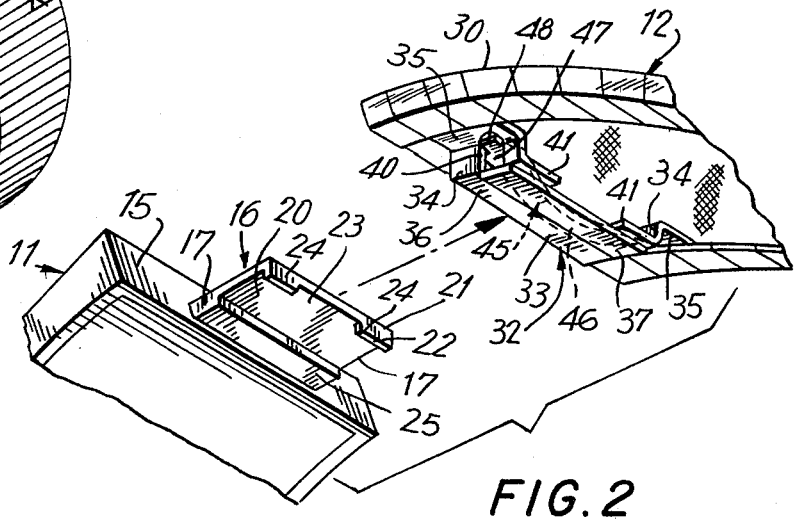
FIG. 2
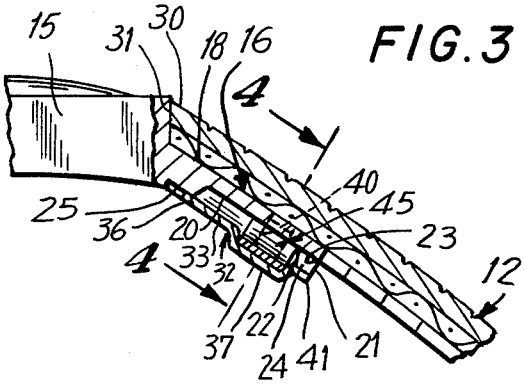
FIG. 3
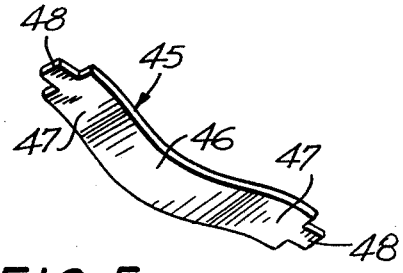
FIG. 5
FIG. 4
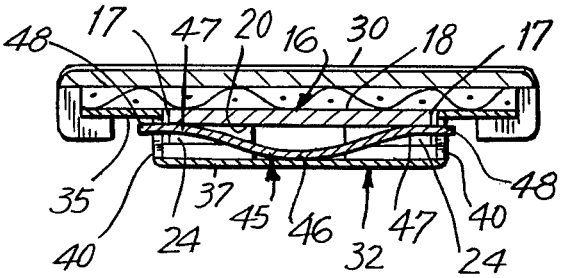

WATCH BRACELET

BACKGROUND OF THE INVENTION

While the field of watch case and band connections is highly developed, there remain in those constructions currently acceptable certain difficulties. For example, currently popular watch band and case connections require the utilization, in addition to the band and case, of one or more separate elements, such as resiliently contractile pivot pins, non-resiliently deformable lock elements, or the like. In addition to the costs of such separate elements, their use considerably increases the difficulty and time consumed in assembly, as by a watchmaker. Examples of such prior art are shown in U.S. Pat. Nos. 3,722,040 and 3,964,652. Further, prior watchband connector constructions have generally required a permanent deformation of the loose or separate lock element after its association with the band, which was difficult and time consuming and often resulted in damage or mutilation of adjacent parts such that the band was incapable of ready replacement or reuse.

SUMMARY OF THE INVENTION

It is, therefore, an important object of the present invention to provide a watch bracelet construction for connection to a watchcase lug, wherein there are no separate components or parts to be handled and assembled, to effect a substantial reduction in the time and difficulty required to fit a watchband and case to a wearer. Further, this new construction requires no permanent deformation of any kind, thereby avoiding or minimizing the possibility of damage or mutilation, which would prevent replacement or reuse.

It is another object of the present invention to provide a watchband construction for attachment to a watchcase wherein a positively retained connection is produced by a unique construction of resiliently deflectable means, which permits deliberate resilient deflection for disengagement or separation without permitting inadvertent or accidental separation, all without sacrifice of low costs, compactness, aesthetics, or other desiderata.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a front perspective view showing a watch including a bracelet constructed in accordance with the teachings of the present invention.

FIG. 2 is an enlarged perspective view showing a watchcase and watchband end portion prior to connection thereof.

FIG. 3 is a partial sectional view taken generally along the line 3—3 of FIG. 1, enlarged for clarity.

FIG. 4 is a transverse sectional view taken generally along the line 4—4 of FIG. 3.

FIG. 5 is a perspective view showing a resilient element of the present invention apart from the remainder thereof.

DESCRIPTION OF THE PREFERRED EMBODIMENT

Referring now more particularly to the drawings, and specifically to FIG. 1 thereof, a watch assembly is there generally designated 10, including a watch 11 and bracelet 12.

The watch 11 is housed in a watchcase or housing 15, from opposite ends of which lugs, arms or connectors 16 project. The lugs or arms 16 may each project outwardly from opposite ends of the watchcase 15 and obliquely downwardly therefrom, only one lug being shown in the drawings for simplicity.

As the lugs 16 may be identical, only a single lug will be described. The lug 16 may be spaced inwardly from opposite sides of the watchcase 15 and bounded on opposite sides by generally parallel side edges 17. The outer or exterior top surface of lug 16 may be generally flat, as at 18, and disposed obliquely to the plane of the watchcase 15. On the underside of lug 16 there may be formed a laterally extending, downwardly facing groove or recess 20, which may open laterally outwardly at its opposite ends through respective lug side walls 17. The lateral or cross-wise groove 20 is located adjacent to and spaced inwardly from the distal end surface or edge 21 of the lug 16, so that the lug material remaining between the distal lug surface 21 and groove 20 may depend or project inwardly in the manner of an inturned lip, tooth or projection 22. Further, the lateral groove 20 may open through the distal end surface 21 of lug 16 in a region spaced intermediate the lug side edges 17, as at 23, so as to divide the lip 22 into a pair of laterally spaced, inturned teeth or bosses 24.

The lateral groove 20 is considerably spaced outwardly from the adjacent end wall of watchcase 15, so as to leave of the lug material between groove 20 and watchcase 15 a raised portion or land 25. The land 25 may be generally coplanar with the projecting end edges of the lips or bosses 24, but spaced from the latter by the groove 20.

In any suitable manner, a lug 16 may be connected to each end wall of the watchcase 15, as by integral formation, braising, or other means.

The bracelet 12 may include a band end portion 30 terminating in a distal end or edge 31 adapted for location contiguous to one end wall of the casing 15. On the inner side of the band end portion 30 there is fixed, by any suitable means, a hollow housing, generally designated 32. The housing 32 extends generally laterally or across the inner side of band 30 and may advantageously be fabricated of suitable sheet metal, as by stamping or other suitable means. Of course, other materials and manufacturing procedures may be employed, as desired. The laterally extending housing 32 includes a major or intermediate portion or wall 33 spaced inwardly from the distal end 31 along the under or inner side of the band end portion 30 and terminating short of opposite side edges of the watchband 12. At opposite ends of the laterally extending intermediate portion or wall 33, spaced inwardly from the side edges of the band end portion 30, are a pair of end portions or walls 34 each extending outwardly toward and generally normal to the inner side of the watchband end portion. From each end position or wall 34, there extends a housing attachment portion or end extension 35, which is suitably fixed to the watchband end portion, as by welding, mechanical connection or the like.

The housing 32 thus extends across the inner side of the band end portion 30 and may have its sides open, one side being open facing toward the watchcase and the other side being open facing away from the watchcase. Thus, it will be apparent that the housing 32 is generally in the nature of a strap on the underside of and spaced from the band end portion for removably receiving the associated lug 16, as will become more fully apparent hereinafter.

The intermediate portion 33 of housing 32 includes an inner housing portion 36 adjacent to the distal end 31 of watchband end portion 30, the inner portion 36 being generally planar and spaced in parallel facing relation with respect to the inner surface of watchband end portion 30 a distance approximately equal to the thickness of lug 16 in the region of land 25.

Contiguous to the inner housing portion 36, and outward thereof away from the distal end 31, the intermediate housing portion 33 is formed with a laterally extending, slightly inwardly depressed region 37, which is offset from the plane of inner portion 36 away from the band end portion 30 a distance approximately equal to the metal thickness, for a purpose appearing presently. In alignment with opposite ends of the depressed region 37 of intermediate housing portion 33, there are formed in the walls 34 respective openings or slots 40 extending generally from the depressed housing region 37 to the adjacent housing end extension 35.

In addition, outwardly of the depressed housing region 37, away from the distal end 31, there are provided adjacent to each wall 34 laterally, inwardly extending boss engaging regions 41, generally coplanar with each other and the inner housing region 36. Thus, the boss engaging regions 41 are in generally parallel, facing relation with the inner surface of the band end portion 30 and spaced therefrom a distance approximating the extension of each boss 24 from the lug surface 18 to the projecting end of the respective boss.

A resiliently deflectable member or strip or leaf spring is generally designated 45 and is best shown in FIG. 5. It will there be apparent that the strip or spring 45 is of a sinuous or generally sinusoidal configuration, having such curvature in its longitudinal direction and being substantially devoid of curvature in its lateral direction or width wise. Further, the leaf spring or resiliently deflectable member 45 may be considered as including a medially located bowed region or crest 46, while its end portions 47 may be considered as reversely bent troughs. Extending longitudinally outwardly from opposite ends of the resiliently deflectable member or leaf spring 45 may be tabs or end extensions 48, say of laterally reduced dimension.

In the assembly, the leaf spring 45 is disposed within the housing 32, specifically having its crest 46 located within and bearing against the internal surface of depressed housing region 37. This is best seen in FIGS. 3 and 4. It will further be seen that the spring 45 has its troughs 47 disposed generally toward the band end portion 30. Further, the spring extends laterally with respect to the band end portion with its end extensions or tabs 48 protruding through and outwardly beyond respective housing openings or slots 40. Thus, by the resilient deflectability of the spring 45, the troughs 47 are resiliently displaceable into the recess of depressed housing portion 37, as by a suitable tool (not shown) displacing accessible tabs or extensions 48 away from the band 30.

From the foregoing, it is believed that the mode of interconnection and disconnection of watchcase 15 with respect to band end portion 30 will be appreciated. That is, by resilient deflection of leaf spring 45 away from the band 30 into the recess of depressed housing portion 37, an internal path is cleared through the housing 32 for insertion of the lug 16 to its full extent with the distal end 31 of the band proximate to the watchcase and the retaining bosses or teeth 24 having passed beyond the leaf spring. The spring 45 may then be released from its deflection into the recess of depressed housing portion 37 for return of its trough portions 47 toward the lug 16. More specifically, the spring troughs 47 move into the lug recess or groove 20, in bearing engagement therewith, the extensions 48 moving in their respective slots 40 to the condition shown in FIGS. 3 and 4. In this lug retaining condition the medial bow or crest 46 of spring 45 is retained in the recess of depressed housing portion 37, while the spring troughs 47 are located for edge engagement with respective bosses 24. As the spring is only resiliently deflectable about cross-wise or lateral axes thereof, and not resiliently deflectable about longitudinal axes of the spring, it will be understood that the side edge bearing engagement of crest 46 in depressed housing region 37, and opposite side edge bearing engagement of troughs 47 with bosses 24 will positively resist inadvertent or undesired disconnection between band end portion 30 and watchcase 15. Further, manipulation of these parts possibly resulting in disconnection is effectively prevented by the substantially complete occupancy of the housing 32 by lug 16 to prevent relative movement therebetween. In particular, the lug 16 has its land 25 substantially completely occupying the space between the band end region 30 and housing sections 41, which is best seen in FIG. 3. In FIG. 4 it will also be apparent that the lateral extent of lug 16 substantially completely occupies the lateral extent of housing 32, so that very limited movement is possible between the lug 16 and the housing 32 in the connected condition.

Of course, disconnection may be quickly and easily achieved by deliberate deflection of spring 45 to displace its troughs 47 into the recess of depressed housing portion 37, so that the spring is located out of the path of movement of the lug 16 and particularly of the lug bosses 24.

From the foregoing, it is seen that the present invention provides a watch bracelet construction which is extremely simple, is capable of economic manufacture for sale at a reasonable price, eliminates the need for separate, loose components, and greatly reduces the skill and difficulty required in connection between a watchband and watchcase, all without the sacrifice of durability, reliability, or aesthetic appearance.

Although the present invention has been described in some detail by way of illustration and example for purposes of clarity of understanding, it is understood that certain changes and modifications may be made within the sprit of the invention.

What is claimed is:

1. A watch bracelet, for connection to a watch casing lug having a retaining boss, said lug having a laterally extending groove located longitudinally inwardly of and defining said boss, and said lug having a land longitudinally inwardly of said groove, comprising a band having an end portion; a hollow housing extending across said band end portion and having one side open for receiving said lug; and a resilient element captive in said housing and normally obstructing the insertion of said lug in said housing, said resilient element being deflectable in said housing to pass said lug with said boss past said resilient element, for retaining engagement of said boss by said resilient element; wherein said resilient element comprises a leaf spring deflectable out of the path of said lug in the direction of, and beyond, said boss to pass said boss and releasable into resilient bearing engagement with said lug and positive retaining engagement with said boss; said leaf spring has a crest remote from said band and has spaced troughs proximate to said band for deflection of at least one of said troughs away from said band to pass said lug and boss, said troughs being in bearing engagement with said groove during connection of the watch casing and the bracelet; and said housing is spaced from a portion of said band adjacent to the land for conforming engagement with said band when said trough of said spring is in said groove.

2. A watch bracelet according to claim 1, wherein said housing has an internal hollow facing toward said band for receiving said spring.

3. A watch bracelet according to claim 2, said housing is spaced from a portion of said band remote from the band end for conforming engagement with said boss when said trough of said spring is in said groove.

4. A watch bracelet according to claim 1, wherein said leaf spring has its longitudinal dimension extending laterally of said band and transversely of lug entry, and has its width extending longitudinally about said band and lug entry, for retaining engagement of said boss by a longitudinal end portion of said leaf spring.

5. A watch bracelet according to claim 1, wherein said housing has a slot extending generally normal to said band, an extension on said leaf spring being slidable in said slot for spring movement toward and way from said band.

6. A watch bracelet according to claim 1, wherein said leaf spring is configured generally sinusoidal.

* * * * *